United States Patent [19]

Sonderby

[11] Patent Number: 4,883,109

[45] Date of Patent: Nov. 28, 1989

[54] ROLLER BLIND FOR SKYLIGHTS

[75] Inventor: Svend A. Sønderby, Videbaek, Denmark

[73] Assignee: V. Kann Rasmussen Industri A/s, Søborg, Denmark

[21] Appl. No.: 197,705

[22] Filed: May 23, 1988

[30] Foreign Application Priority Data

May 26, 1987 [DE] Fed. Rep. of Germany ..... 3717681

[51] Int. Cl.[4] ..... E04F 10/08; E06B 9/26

[52] U.S. Cl. ..... 160/32; 160/23.1; 160/319

[58] Field of Search ..... 160/23.1, 32, 309, 316, 160/313, 319

[56] References Cited

U.S. PATENT DOCUMENTS

| | | | |
|---|---|---|---|
| 1,257,316 | 2/1918 | Clark | 160/23.1 |
| 3,768,540 | 10/1973 | McSwain | 160/23.1 |
| 4,088,170 | 5/1978 | Franklin | 160/84.1 |
| 4,202,395 | 5/1980 | Heck et al. | 160/84.1 |
| 4,398,585 | 8/1983 | Marlow | 160/23.1 |
| 4,492,261 | 1/1985 | Chong | 160/319 |
| 4,610,292 | 9/1986 | Hausmann et al. | 160/23.1 X |
| 4,712,598 | 12/1987 | Bonacci et al. | 160/84.1 |

FOREIGN PATENT DOCUMENTS

| | | | |
|---|---|---|---|
| 257602 | 11/1963 | Australia | 160/178.1 |
| 150855 | 5/1904 | Fed. Rep. of Germany | 160/23.1 |
| 151051 | 5/1904 | Fed. Rep. of Germany | 160/23.1 |
| 7825978 | 2/1979 | Fed. Rep. of Germany . | |
| 28471275 | 5/1980 | Fed. Rep. of Germany . | |
| 3219570 | 12/1983 | Fed. Rep. of Germany | 160/178.1 |
| 2418860 | 11/1979 | France | 160/23.1 |
| 431771 | 12/1948 | Italy | 160/23.1 |
| 67549 | 2/1914 | Switzerland | 160/23.1 |

*Primary Examiner*—Robert W. Gibson, Jr.
*Assistant Examiner*—Kolman David G.
*Attorney, Agent, or Firm*—Majestic, Parsons, Siebert & Hsue

[57] ABSTRACT

A roller blind for skylights, having a roller blind compartment (4) which can be fitted on the upper part of the blind, a winding shaft (6) rotatably mounted in the compartment and a strap drum (8) coaxially connected, for joint rotation, to the winding shaft for a pulling strap (9), has a plurality of strap deflecting elements (10, 11, 12 13) arranged in the roller blind compartment (4), which elements deflect the pulling strap (9), extending from the strap drum (8), with axial strap twisting, firstly substantially parallel to the winding shaft (6), then substantially parallel to the central plane of the strap drum and then substantially perpendicular to the plane of exit of the roller blind toward the window, whence, in the installed position, it runs through a strap opening (3*a*) in the outer covering of the frame upper piece between the latter and a cover part engaging underneath its outer covering directly to a strap winder, preferable fitted above the window.

14 Claims, 2 Drawing Sheets

ROLLER BLIND FOR SKYLIGHTS

Figure 1:
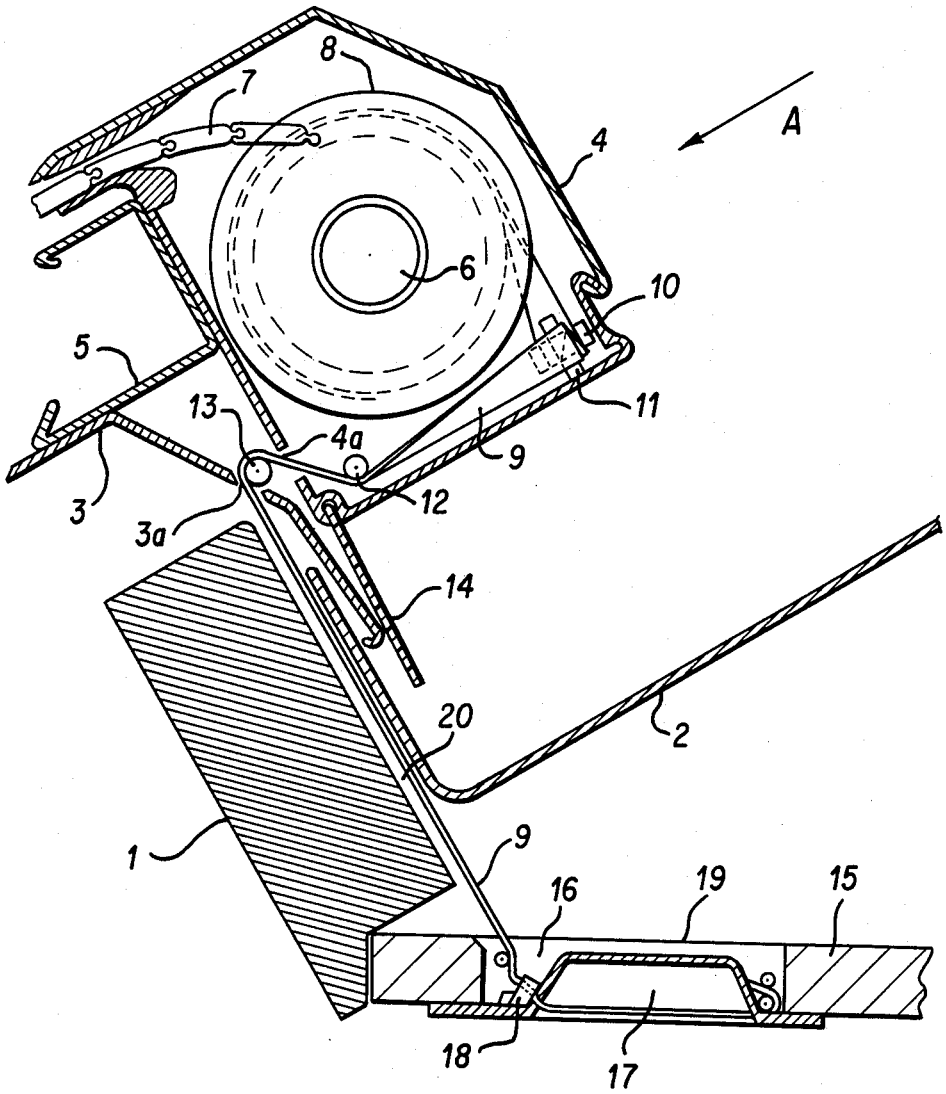

The invention relates to a roller blind for skylights, having a roller blind compartment which can be fitted on the upper part of the blind, a winding shaft rotatably mounted in the compartment and a strap drum coaxially connected to the winding shaft for a pulling strap leading to the inside of the room and connected if necessary to a strap winder.

In a known roller blind of this type, the pulling strap is led from the strap drum, arranged close to a lateral end of the roller blind compartment and rotatable together with the winding shaft, through a strap channel to be additionally fitted in the frame of the skylight, to a strap winder projecting on the inside of the frame. This has, however, the disadvantage that the strap channel, which is frequently to be produced in the frame of the window only after its installation, cannot be sealed off sufficiently reliably against the ingress of rainwater and blown snow, as well as against the formation of ice, and the pulling strap leaving the strap winder fixed projecting from the inside surface of the frame is only accessible with difficulty when the window is slightly open.

On vertically installed windows, the sealing of which presents less problems than on skylights, it is known from German Utility Model GM No. 7,825,978 to deflect the pulling strap.

In the case of another design, known from German Offenlegungsschrift 2,847,127, the pulling strap is led from the strap drum through a strap tube, led outside the frame through the roofing, to a strap winder recessed into the interior wall of the room alongside the strap tube in the lower section of the skylight. However, in this case the fitting of the strap tube led from the roller blind compartment through the roofing taking place not until installation is time-consuming and cannot really be sealed off reliably. In addition, in many cases there is not sufficient wall surface available laterally alongside the installed window for the installation of the strap winder for the pulling strap to be led down on the interior wall.

Therefore the object of the invention is to create a roller blind for skylights of the type mentioned at the beginning which, with a construction which is uncomplicated to produce, results in a reliable sealing and can be operated conveniently in every position of the window casement.

To achieve this object, according to the invention the roller blind of the said type has the features of patent claim 1.

Due to the deflection in the roller blind compartment, at a point which is located between the frame upper piece and an adjoining cover part and is shifted in longitudinal direction of the winding shaft by a suitable distance in the direction towards the center of the skylight, the pulling strap can be led directly to a strap winder arranged above the window, so that a relatively small strap length results and the strap winder is easily accessible. For retrofitting on an already installed skylight, all that is needed is to make a small strap opening in the outer covering of the frame and then fit the roller blind compartment on the outside and the strap winder on the inside above the window. A strap winder of the type described in the Applicant's parallel German Patent Application P 37 17 680.3-25 of the same application date is particularly suitable for this purpose.

Advantageous further developments of the roller blind are described in the subclaims.

If the pulling strap runs though a strap opening in the outer covering of the frame upper piece between the latter and cover part engaging underneath the covering of the outer piece directly to a strap winder inserted in the lintel surface or a lining fitted there, and the pulling strap consequently only has a small length, both the strap drum in the roller blind compartment and the strap drum of the strap winder have correspondingly smaller dimensions.

Figure 2:
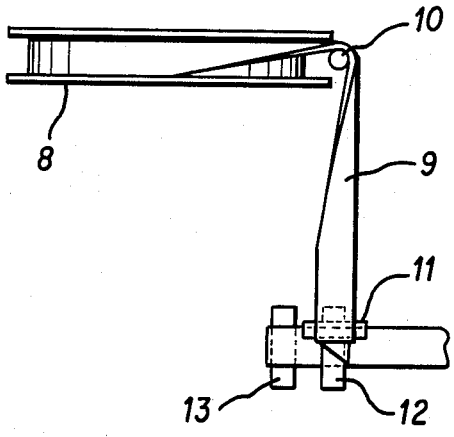

A preferred embodiment of the roller blind is further explained below with reference to the enclosed drawings, in which:

FIG. 1 shows a diagrammatic cross-section through the roller blind compartment fitted on an installed skylight, with representation of the path taken by the pulling strap to a strap winder, and FIG. 2 shows a diagrammatic representation of the strap drum and of the strap deflection elements in the roller blind compartment, seen in the direction of arrow A of FIG. 1.

The roller blind represented in FIG. 1 is fixed with its roller blind compartment 4 via a support rail 5, connected to the latter, on an awning compartment 3 forming the outer covering of the frame upper piece 1 of a skylight. In the roller blind compartment 4 there is rotatably mounted in the usual way a winding shaft 6, in a bearing device (not shown). The winding shaft 6 serves for the winding-up of the roller blind 7, which, during its closing movement, leaves the roller blind compartment 4 via a slot running substantially parallel to the plane of the window and is led in a known way in roller blind guide rails (not shown), which are connected to the roller blind compartment 4 rigidly or preferably such that they can be deflected jointly outward and expediently interact with spacers on the window casement, which spacers are guided displacably in the roller blind guide rails.

A strap drum 8 is coaxially connected, for joint rotation, to the winding shaft 6 in the usual way. On the strap drum 8, one end of a pulling strap 9 is fixed, which is wound up onto the strap drum during the movement of the roller blind 7 into its closed position. By pulling on the pulling strap 9, the closed roller blind 7 can be wound up onto the winding shaft 6 against the force of scroll springs, or similar spring devices, arranged on the roller blind guide rails, the pulling strap 9 at the same time being unwound from the strap drum 8.

In the case of the embodiment shown, the pulling strap 9, extending tangentially from the strap drum 8, is first deflected with axial twisting of its strap surface through about 90° via a deflection roller 10, which is in the roller blind compartment 4 and is rotatable about an axis of rotation perpendicular to the winding shaft 6, parallel to the winding axis 6, is then deflected by a deflection roller 11, which is arranged in the roller blind compartment 4 and has an axis of rotation perpendicular both to the deflection roller 10 and to the winding shaft 6, with renewed axial strap twisting through 90° approximately parallel to the lower wall of the roller blind compartment and thereby, again with axial strap twisting, via a further strap deflection roller 12, which has an axis of rotation parallel to the winding shaft 6, whence it leaves through a strap exit 4a in the wall of the roller blind compartment and is deflected via a deflection roller 13, which is provided on the roller blind compartment 4 and is likewise rotatable about an axis of rotation parallel to the winding shaft 6, such that it is fed without contact through a small strap opening 3a in the awning compartment 3 and through a gap 20 located between the frame upper piece 1 and a cover part 2, engaging underneath the awning compartment 3, to a strap winder 17, which is installed in a recess 16 of a liner lintel board 15 fitted on the inside edge of the frame upper piece 1.

The strap winder 17, only represented diagrammatically, corresponds to the construction described in the applicant's parallel German Patent application p 37 17 680.3-25 of the same application date and has a recessed grip 19, which is arranged in the base plate and through which the pulling strap 9 passes, a strap clamping device 18, which is arranged in front of the recess in strap direction to the roller blind and has a strap guide roller 21 connected ahead of it and strap deflection rollers 22 and 23, arranged on the opposite side of the recessed grip 19, via which rollers the pulling strap 9 is fed to a strap drum (not shown), located laterally behind the recessed grip 19. The space between the lining lintel board 15 and the frame-like cover part 2 is filled in the usual way with heat insulating material (not shown). At the corner edge, facing the cover frame upper piece 1, of the roller blind compartment 4, a flexible sealing strip 14 is fitted, which bears against the end edge of the awning compartment 3, overlapping it. The rainwater etc. flowing off the roofing (not shown) extending over the cover part 2, cannot therefore get into the space having the strap opening 3a between roller blind compartment 4 and awning compartment 3. If the frame upper piece 1 is not provided with an awning compartment 3, the strap opening 3a is located in the usual outer covering of the frame upper piece 1, so that a reliable seal is likewise ensured.

As can be seen in particular from comparative consideration of FIGS. 1 and 2, in the case of the embodiment shown, the pulling strap 9 is deflected by the strap deflection rollers 10, 11 and 12, the axes of rotation of which in each case run perpendicular to those of the two other deflection rollers, in each case with axial twisting of the strap surface through approximately 90°. The strap deflection roller 12 could also be omitted if its deflection function were transferred directly to the strap deflection roller 13.

As FIG. 2 shows, in the case of the roller blind according to the invention, the exit point of the pulling strap 9 from the roller blind compartment 4 is shifted by a freely selectable distance in longitudinal direction of the winding shaft 6 relative to the central plane of the strap drum 8, so that the strap opening 3a and the point of passage of the pulling strap 9 through the gap 20 takes place at the particular point desired between the frame side pieces and the strap winder 17 can accordingly be fitted an adequate horizontal distance from the side parts of the lining, which facilitates easy operation.

In a modified construction (not shown), the pulling strap 9 can be drawn off the strap drum 8 on the opposite side, facing the support rail 5, tangentially from the strap drum 8 outward from the window, and deflectd with axial strap twisting via a deflection roller, which is arranged just in front of the exit slot of the roller blind 7 and parallel to the deflection roller 10, parallel to the winding shaft 6, and then returned, without axial strap twisting, around a further, parallel strap deflection roller along the wall of the roller blind compartment 4 adjoining the support rail 5 and, with renewed axial strap twisting, fed through a suitable strap outlet directly to the strap deflection roller 13.

The roller blind explained above with reference to a preferred embodiment can be appropriately modified to the requirements of the individual case in various ways by a person skilled in the art, it being intended in particular that the dimensions of the roller compartment 4, the arrangement, design and alignment of the strap deflection elements provided therein and of the strap outlet 4a are adapted to the design of the skylight and its strap opening 3a in such a way that, apart from the desired shifting of the strap exit point in longitudinal direction of the winding shaft 6, a well-sealing trouble-free pulling strap guidance of the strap winder fitted closely alongside the frame upper piece is made possible.

I claim:

1. A roller blind for use with skylights mounted on a roof, said roller blind having a frame upper piece, an outer covering, a roller blind compartment which can be fitted on the upper part of the blind, a winding shaft rotatably mounted in the compartment and a strap drum coaxially connected to the winding shaft for a pulling strap leading to the inside of the room and connected if necessary to a strap winder, wherein there are arranged (a) in the roller blind compartment (4) at least a first strap deflecting element (10) for deflection of the pulling strap (9) leaving the strap drum (8) into a direction substantially parallel to the winding shaft (6), and (b) at least a second strap deflecting element (11) for further deflection of the pulling strap (9) into a direction substantially parallel to the central plane of the strap drum (8), and (c) at least a third strap deflecting element (13) is provided for deflection of the pulling strap (9) into a direction running outward from the window substantially perpendicular to the exit plane of the roller blind (7) from the roller blind compartment (4), said strap deflecting element (13) being mounted on the roller blind compartment (4) spaced from said first strap deflecting element to a point proximate to the frame upper piece (1) so that the pulling strap (9) can, in the installed position, be led inward through a strap opening (3a), made in said outer covering (3) of a frame upper piece (1), said pulling strap being located between said frame upper piece (1) and a cover part (2) said cover part being partially disposed between said outer covering (3) and said frame upper piece thereby avoiding passing of the strap through the roof and the inherent sealing problems associated therewith.

2. A roller blind as claimed in claim 1, wherein a first strap deflecting element (10), deflecting a pulling strap (9), extending tangentially from the strap drum (8) toward the window, approximately at right angles with axial belt twisting, a second strap deflecting element (11), deflecting the pulling strap (9) with renewed axial strap twisting into a direction substantially parallel to the direction of exit of the roller blind (9), and at least one third strap deflecting element (12, 13), deflecting the pulling strap (9) again with axial strap twisting, are provided.

3. A roller blind as claimed in claim 1 or 2, wherein at least one strap deflecting element is designed as a rotatably mounted strap deflecting roller (10 to 13).

4. A roller blind as claimed in claim 3, wherein said three adequately spaced apart strap deflecting rollers (10, 11, 13) are provided with axes of rotation in each case substantially perpendicular to the axes of rotation of the two others.

5. A roller blind as claimed in claim 3, wherein at least one strap deflection roller (10 to 13) has a circumferential surface which in longitudinal section is concavely grooved and has an increase in diameter toward the roller ends to counteract jumping-off of the pulling strap (9).

6. A roller blind as claimed in claim 3, wherein the axis of rotation of at least one strap deflection roller (10 to 13) is inclined at a predetermined angle with respect to the perpendicular to a plane corresponding approximately to the center lines of the associated sections of the pulling strap (9).

7. A roller blind as claimed in claim 1, wherein at least one strap deflecting element is designed unrotatably with a rigid sliding surface.

8. roller blind as claimed in claim 1, wherein at least one strap deflecting element is designed as a deflection ring with a toroidally rounded sliding surface, through which the pulling strap (9) passes.

9. A roller blind as claimed in claim 1, wherein there is arranged in the roller blind compartment (4), between the second and third strap deflection rollers (11, 13), a further strap deflection roller (12) with axis of rotation parallel to the third strap deflection roller (13).

10. A roller blind as claimed in claim 1, wherein there is arranged on the region of the roller blind compartment (4) opposite the frame upper piece (1) in installed position, a seal (14) bearing against the outer covering (3) of the frame upper piece (1).

11. A roller blind for skylights, said roller blind having a roller blind compartment which can be fitted on the upper part of the blind, a winding shaft rotatably mounted in the compartment and a strap drum coaxially connected to the winding shaft for a pulling strap leading to the inside of the room and connected if necessary to a strap winder, wherein there are arranged (a) in the roller blind compartment (4) at least a first strap deflecting element (10) for deflection of the pulling strap (9) leaving the strap drum (8) into a direction substantially parallel to the winding shaft (6), and (b) at least a second strap deflecting element (11) for further deflection of the pulling strap (9) into a direction substantially parallel to the central plane of the strap drum (8), and (c) at least a third strap deflecting element (13) is provided for deflection of the pulling strap (9) into a direction running outward from the window substantially perpendicular to the exit plane of the roller blind (7) from the roller blind compartment (4), said strap deflecting element (13) being mounted on the roller blind compartment (4) spaced from said first strap deflecting element to a point proximate to the frame upper piece (1) so that the pulling strap (9) can, in the installed position, be led inward through a strap opening (3*a*), made in said outer covering (3) of a frame upper piece (1), said pulling strap being located between said frame upper piece (1) and a cover part (2) said cover part being partially disposed between said outer covering (3) and said frame upper piece, wherein the third strap deflecting element (13) is arranged on the roller blind compartment (4) in such a way that, in the installed position, it feeds the pulling strap (9) through the strap opening (3) directly to a strap winder (17), to be fitted on the inside of the gap (20) between the frame upper piece (1) and the cover part (2) above the skylight.

12. A roller blind for skylights, said roller blind having a roller blind compartment which can be fitted on the upper part of the blind, a winding shaft rotatably mounted in the compartment and a strap drum coaxially connected to the winding shaft for a pulling strap leading to the inside of the room and connected if necessary to a strap winder, wherein there are arranged (a) in the roller blind compartment (4) at least a first strap deflecting element (10) for deflection of the pulling strap (9) leaving the strap drum (8) into a direction substantially parallel to the winding shaft (6), and (b) at least a second strap deflecting element (11) for further deflection of the pulling strap (9) into a direction substantially parallel to the central plane of the strap drum (8), and (c) at least a third strap deflecting element (13) is provided for deflection of the pulling strap (9) into a direction running outward from the window substantially perpendicular to the exit plane of the roller blind (7) from the roller blind compartment (4), said strap deflecting element (13) being mounted on the roller blind compartment (4) spaced from said first strap deflecting element to a point proximate to the frame upper piece (1) so that the pulling strap (9) can, in the installed position, be led inward through a strap opening (3a), made in said outer covering (3) of a frame upper piece (1), said pulling straps being located between said frame upper piece (1) and a cover part (2), said cover part being partially disposed between said outer covering (3), and said frame upper piece, wherein the third strap deflection drum (13) feeds the pulling strap (9) to a strap winder (17), which is inserted in a lining (15) and has a recessed grip (19) through which the pulling strap (9) passes, the recessed grip (19) having a strap clamping device (18) ahead of it and a strap winding drum, pretensioned by spring force in winding direction, behind it, in strap direction toward the roller blind (7).

13. A roller blind as claimed in claim 12, wherein the strap winder (17) has at least one strap guide roller (21) ahead of the strap clamping device (18) in strap direction to the roller blind (7).

14. A roller blind as claimed in claim 12, wherein the strap winding drum of the strap winder (17) is arranged laterally alongside the recessed grip (19) and the pulling strap (9) is led via at least one strap deflection roller (22, 23), arranged on the side of the recessed grip (19) facing away from the strap clamping device (18), obliquely to a strap guide roller mounted between the recessed grip (19) and the strap winding drum.

* * * * *